US005279688A

United States Patent [19]

Isokawa et al.

[11] Patent Number: 5,279,688

[45] Date of Patent: Jan. 18, 1994

[54] STEEL SHAFT MATERIAL WHICH IS CAPABLE OF BEING DIRECTLY CUT AND INDUCTION HARDENED AND A METHOD FOR MANUFACTURING THE SAME

[75] Inventors: Kenji Isokawa, Aichi; Sadayuki Nakamura, Mie; Toshimitsu Fujii, Tokai, all of Japan

[73] Assignee: Daido Tokushuko Kabushiki Kaisha, Nagoya, Japan

[21] Appl. No.: 893,237

[22] Filed: Jun. 3, 1992

Related U.S. Application Data

[63] Continuation-in-part of Ser. No. 619,077, Nov. 28, 1990, abandoned.

[30] Foreign Application Priority Data

Dec. 6, 1989 [JP] Japan ..... 1-317268

[51] Int. Cl.[5] ..... C22C 38/14

[52] U.S. Cl. ..... 148/330; 148/335; 148/654; 420/121

[58] Field of Search ..... 148/330, 335, 654; 420/121, 107

[56] References Cited

U.S. PATENT DOCUMENTS 4,406,711 9/1983 Nagumo et al. ..... 148/12 R
4,898,629 2/1990 Lang et al. ..... 148/12 B

FOREIGN PATENT DOCUMENTS 59-170239 9/1984 Japan .
59-200724 11/1984 Japan .
63-216920 9/1988 Japan .

*Primary Examiner*—Deborah Yee
*Attorney, Agent, or Firm*—Frishauf, Holtz, Goodman & Woodward

[57] ABSTRACT

A steel shaft material having desirable cuttability and induction hardenability even in the form of milled stock without being subjected to any heat treatment, such as annealing, and a method for manufacturing the same. A steel ingot is prepared containing 0.38 to 0.45 wt. % of carbon, 0.15 wt % or less of silicon, 0.3 to 1.0 wt % of manganese, 0.0005 to 0.0030 wt % of boron, 0.01 to 0.05 wt % of titanium, 0.01 to 0.06 wt % of aluminum, 0.010 wt % or less of nitrogen, optionally at least one of chromium in an amount of 0.3 wt % or less and molybdenum in an amount of 0.10 wt % or less, and optionally at least one of 0.005 to 0.30 wt % of sulfur, 0.0002 to 0.005 wt % of calcium, 0.005 to 0.30 wt % of lead and 0.005 to 0.10 wt % of tellurium, and the remainder being iron and unavoidable impurities. After the ingot is heated to 1,100° C. or less, the ingot is milled at a finishing temperature of 950° C. or below and an area reduction rate of 70% or higher, and then cooled in the atmosphere. The steel material of the present invention has a microstructure formed of ferrite and lamellar pearlite (the amount which remains bainite being %5 or less) and having a ferrite grain size number of 6 or higher, as determined by JISG0552, a HRB hardness of 80 to 90, as determined by JISZ2245, and a DM-T decarbonized depth of 0.20 mm or less, as determined by JISG0558.

19 Claims, 1 Drawing Sheet

STEEL SHAFT MATERIAL WHICH IS CAPABLE OF BEING DIRECTLY CUT AND INDUCTION HARDENED AND A METHOD FOR MANUFACTURING THE SAME

CROSS-REFERENCE TO RELATED APPLICATION

This application is a continuation-in-part application of application Ser. No. 07/619,077, filed Nov. 28, 1990, now abandoned.

BACKGROUND OF THE INVENTION

The present invention relates to a steel material for induction hardening capable of direct cutting. More specifically, the invention relates to a steel material which can enjoy high cuttability without being annealed, so that it can be cut or rolled directly after it is milled, and which also enjoys satisfactory high-frequency induction hardenability, so that it is adapted particularly for use as a material for a drive shaft of an automobile.

Conventionally, a drive shaft of an even-speed joint is manufactured as follows. SAE-1541, for use as a steel ingot to be milled, is annealed or spheroidized to have improved cuttability, then cut or roll-finished into a predetermined shape, and finally subjected to induction hardening.

SAE-1541 is poor in cuttability, and, it will shorten the life of a cutting tool, and consume plenty of heat energy during heat treatment in the process preceding the machining processes. Thus, the SAE-1541 is not a very economical material.

Presently available, in consideration of these circumstances, is a steel ingot (e.g., ingot of JISS40C) whose cuttability is improved by reducing the manganese content of the SAE-1541. This steel ingot, however, is subjected to drawbacks including poor induction hardenability and variation in the depth of the case after hardening.

SUMMARY OF THE INVENTION

An object of the present invention is to provide a steel shaft material having high cuttability and capable of being cut or roll-finished in the form of milled stock without being subjected to any heat treatment, such as annealing, and a method for manufacturing the same.

Another object of the invention is to provide a steel shaft material having satisfactory induction hardenability and requiring a smaller cutting allowance after hardening.

Still another object of the invention is to provide a steel shaft material capable of dispensing with heat treatment, such as annealing, so that heat energy can be saved, and the cutting allowance can be reduced, thus ensuring a great economical effect.

According to the present invention, there is provided a steel shaft material which is capable of being cut and induction hardened, which comprises 0.38 to 0.45 wt % of carbon, 0.15 wt % or less of silicon, 0.3 to 1.0 wt % of manganese, 0.0005 to 0.0030 wt % of boron, 0.01 to 0.05 wt % of titanium, 0.01 to 0.06 wt % of aluminum, 0.010 wt % or less of nitrogen, optionally at least one of chromium in an amount of 0.3 wt % or less and molybdenum in an amount of 0.10 wt % or less, and optionally at least one of 0.005 to 0.30 wt % of sulfur, 0.0002 to 0.005 wt % of calcium, 0.005 to 0.30 wt % of lead and 0.005 to 0.10 wt % of tellurium, and iron and unavoidable impurities for the remainder.

The steel material of the present invention has a microstructure formed of ferrite and lamellar pearlite (the amount of bainite being 5% or less) and having the ferrite grain size number of 6 or higher, as provided by JISG0552, a hardness of HRB 80 to 90, as provided by JISZ2245, and a decarbonized depth of DM-T 0.20 mm or less, as provided by JISG0558.

According to the present invention, moreover, there is provided a method for manufacturing a steel shaft material for induction hardening capable of direct cutting.

The manufacturing method of the present invention comprises a step for preparing a steel ingot consisting mainly of 0.38 to 0.45 wt % of carbon, 0.15 wt % or less of silicon, 0.3 to 1.0 wt % of manganese, 0.0005 to 0.0030 wt % of boron, 0.01 to 0.05 wt % of titanium, 0.01 to 0.06 wt % of aluminum, 0.010 wt % or less of nitrogen, optionally at least one of chromium in an amount of 0.3 wt % or less and molybdenum in an amount of 0.10 wt % or less, and optionally at least one of 0.005 to 0.30 wt % of sulfur, 0.0002 to 0.005 wt % of calcium, 0.005 to 0.30 wt % of lead and 0.005 to 0.10 wt % of tellurium, and iron and unavoidable impurities for the remainder, a step for heating the steel ingot to a heating temperature of 1,100° C. or below, a step for milling the steel ingot at a finishing temperature of 950° C. or below and an area reduction rate of 70% or higher, and a step for cooling the milled material in the atmosphere.

DETAILED DESCRIPTION

Figure 1:
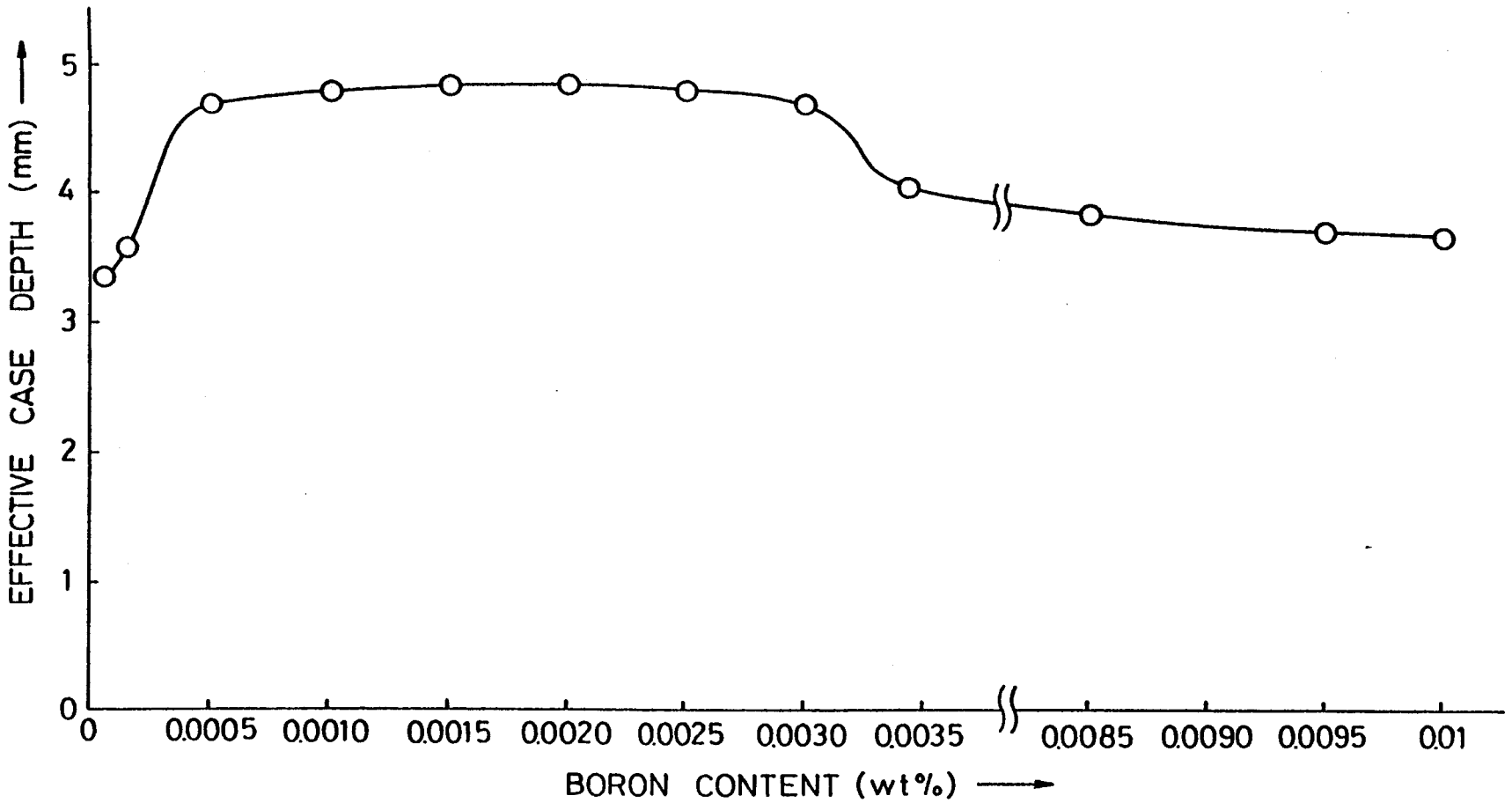
FIG. 1 is a graph showing the relationship between the content of boron in steel and an effective case depth.

The ferrite grain size number of a steel shaft material according to the present invention is 6 or higher. If this number is lower than 6, the steel shaft material lacks in tenacity. The ferrite grain size number is measured according to JISG0552.

JIS G 0552 is entitled "Methods of Ferrite Grain Test for Steel".

This Japanese Industrial Standard specifies the testing method of measuring ferrite grain size, hereinafter referred to as "grain size", of steel mainly with a carbon content not more than 0.2 percent.

In measurements made by the intercept method the following formula shall apply to the expression of grain size number.

The grain size number shall be rounded off to the first decimal place.

$$n = 500\left(\frac{M}{100}\right)^2\left(\frac{l_1 \cdot l_2}{L_1 \cdot L_2}\right)$$

$$N = \frac{\log n}{0.301} + 1$$

wherein

N: grain size number n: number of grain size in 25 $mm^2$ under a microscope of 100 magnification M: microscope magnification $L_1$ (or $L_2$): total length (in mm) of one linear length of the segments orthogonally crossing each other $I_1$ (or $I_2$): total number of crystal grain intercepted by $L_1$ (or $L_2$)

Preparation of Test Piece: Steel with the section parallel to or at a right angle to the working direction shall be etched after being finished by polishing. For this etching, a solution, preferably of about 5 percent nitric acid alcohol, should be applied for 15 seconds.

Testing Methods—Intercept Method: The number of the ferrite crystal grain intercepted by the 2 segments of a fixed length orthogonally crossing each other shall be determined by observing the grains appearing on the etched plane under a microscope of by means of a photomicrograph.

Preferably, the ferrite grain size number is 7 or higher, further preferably 8 or higher.

A microstructure is formed of ferrite and lamellar pearlite. The amount of bainite within the phase of the microstructure is limited to 5% or less, preferably to 0%. If the amount of bainite is higher than 5%, the steel shaft material is so hard that its cuttability is lowered, and the life of a mold used is shortened during roll finishing.

If the hardness is higher than HRB 90, the cuttability of the steel shaft material is lowered, and the mold life is shortened during the roll finishing. If the hardness is lower than HRB 80, on the other hand, the steel shaft material lacks in strength, and its cuttability is lowered. Accordingly, the hardness of the steel shaft material is set within the range of HRB 80 to 90. The hardness is measured according to JISZ2245.

JIS Z 2245 is entitled "Method of Rockwell Superficial Hardness Test".

When a steel ball having a diameter of 1.5875 mm is preliminary pressed under a standard load of 10 kgf, additionally applied the test load (100 kgf) and then applied the standard load (10 kgf) again, the hardness shall be determined by the difference between the depth "h" (μm) of indentations under those two standard loads mentioned above and also by using the following formula. When the standard weight is 98.07N (10 kgf), it is nominated Rockwell hardness $$130 - \frac{h}{2}.$$

Preferably, the hardness ranges from HRB 82 to 88, further preferably from HRB 84 to 86.

If the decarbonized depth is too deep, the induction hardening cannot fully advance, a satisfactory case cannot be formed, and the cutting allowance increases. Therefore, the depth of decarbonization is restricted to DM-T 0.20 mm or less. The decarbonized depth is measured according to JISG0558.

JIS G 0558 is entitled "Method of Measuring Decarburized Depth for Steel".

Total Decarburized Depth (DM-T): Distance from the surface of the decarburized layer to the position where the difference in chemical or physical properties between the decarburized layer and the core material is no longer determinable.

Measuring Method by Microscope: Method of measuring the decarburized depth by microscope on the section of the test piece after etched.

The decarburized depth shall be expressed in mm.

Preferably, the decarbonized depth is limited to DM-T 0.15 mm or less, further preferably to DM-T 0.10 mm or less.

If the carbon content of the steel material is lower than 0.38 wt %, the induction hardenability of the material is lowered, and the central portion of the material lacks in strength. If the carbon content exceeds 0.45 wt %, on the other hand, the steel shaft material is reduced in cuttability and in rollability, and is increased in milled hardness and in susceptibility to hardening cracks caused by the induction hardening. Accordingly, the carbon content is set within the range of 0.38 to 0.45 wt %.

Preferably, the carbon content ranges from 0.39 to 0.41 wt %.

Silicon is an element which is effective for the reduction of the milled hardness.

The lower the silicon content, the lower the milled hardness is. Therefore, the silicon content is adjusted to 0.15 wt % or less, further preferably 0.10 wt % or less.

If the manganese content of the steel shaft material is lower than 0.3 wt %, the induction hardenability of the material is lowered, and the central portion of the material lacks in strength. If the manganese content exceeds 1.0 wt %, on the other hand, the steel shaft material is reduced in cuttability and in rollability, and is increased in milled hardness and in susceptibility to hardening cracks caused by the induction hardening. Accordingly, the manganese content is set within the range of 0.3 to 1.0 wt %.

Preferably, the manganese content ranges from 0.50 to 0.90 wt %, further preferably from 0.60 to 0.80 wt %.

As the boron content is increased up to 0.0005 wt %, the depth of the effective case of the steel shaft material correspondingly increases and the induction hardenability of the material is improved. If the boron content exceeds 0.0005 wt %, however, the increase of the induction hardenability of the steel material becomes almost saturated and shows no significant improvement. If the boron content exceeds 0.0030 wt %, the induction hardenability slightly lowers, and where the boron content is greater than 0.0035 wt % or thereabout, the induction hardenability is maintained at the slightly lowered level. Accordingly, the boron content is set within the range of 0.0005 to 0.0030 wt %.

Preferably, the boron content ranges from 0.0010 to 0.0030 wt %, further preferably from 0.0010 to 0.002 wt %.

Titanium and aluminum are elements which serve to fix oxygen and nitrogen in the steel shaft material. If the titanium and/or aluminum content of the steel shaft material is lower than 0.01 wt %, the fixing effect cannot be fulfilled. If this content is too high, the cleanliness of the steel shaft material is lowered. Accordingly, the titanium content is set within the range of 0.01 to 0.05 wt %, preferably from 0.015 to 0.045 wt %, and further preferably from 0.020 to 0.035 wt %, while the aluminum content is set within the range of 0.01 to 0.06 wt %, preferably from 0.015 to 0.045 wt %, and further preferably from 0.015 to 0.035 wt %.

If the nitrogen content of the steel shaft material exceeds 0.010 wt %, the amount of a TiN-based nonmetallic inclusion produced by the reaction between nitrogen and titanium as another additive increases, so that the millability and cuttability of the steel material are lowered. Accordingly, the nitrogen content is restricted to 0.010 wt % or less.

Preferably, the nitrogen content is 0.008 wt % or less, further preferably 0.006 wt % or less.

In order to improve the induction hardenability of the steel shaft material of the present invention, chromium and/or molybdenum should preferably be added besides the aforesaid elements. If chromium or molybdenum is added too much, the milled hardness of the resulting steel shaft material increases, and its cuttability and rollability lower. Accordingly, the chromium content is restricted to 0.30 wt % or less, preferably to 0.20 wt % or less, and further preferably from 0.10 to 0.20 wt %, while the molybdenum content is restricted to 0.10 wt % or less, preferably from 0.005 to 0.10 wt %. The addition of chromium is effective in preventing the decarbonization.

In order to further improve the cuttability of the steel shaft material of the present invention, good-cuttability elements, such as 0.005 to 0.30 wt % of sulfur, 0.0002 to 0.005 wt % of calcium, 0.005 to 0.30 wt % of lead, and 0.005 to 0.10 wt % of tellurium, may naturally be added as required.

Further, the steel shaft material of the present invention may contain 0.30 wt % or less of copper and 0.25 wt % or less of nickel as impurities.

The steel shaft material of the present invention is manufactured by preparing a steel ingot of the aforementioned composition, cold-milling the resulting steel ingot under the following conditions, and then cooling the milled steel in the atmosphere.

If the steel ingot is heated to a temperature higher than 1,100° C. during the milling operation, decarbonization advances so deep that the induction hardenability is lowered. Accordingly, the heating temperature is restricted to 1,100° C. or below. Preferably, the heating temperature is restricted to 1050° C. or below.

If the finishing temperature for the milling operation is higher than 950° C., fine grains cannot be obtained, and the cuttability and strength of the material are lowered. Accordingly, the finishing temperature is restricted to 950° C. or below, for example, to the range of 750° to 950° C. Preferably, the finishing temperature is restricted to 900° C. or below.

If the area reduction rate for the milling operation is lower than 70%, there is a problem such that the grain size is increased and bainite is liable to be produced, thus lowering the processability. Accordingly, the area reduction rate is set at 70% or higher. Preferably, the reduction rate is set 90% or higher, further preferably 95% or higher.

The milled material is then cooled in the atmosphere, and the surface thereof is subjected to induction hardening to thereby harden the surface.

The cooling step may be carried out by leaving the material to stand in the atmosphere to be naturally cooled, or by exposing the material to a current of air produced by a fan.

EXAMPLE 1—10, CONTROL 1—4

Steel ingots of the compositions shown in Table 1 were prepared.

TABLE 1

| | Composition (wt %) | | | | | | | | | | | | |
|---|---|---|---|---|---|---|---|---|---|---|---|---|---|
| | C | Si | Mn | P | S | Cu | Ni | Cr | B | Ti | Al | N | Mo |
| Example 1 | 0.39 | 0.12 | 0.69 | 0.015 | 0.021 | 0.08 | 0.08 | 0.08 | 0.0014 | 0.035 | 0.023 | 0.007 | 0.01 |
| Example 2 | 0.39 | 0.14 | 0.98 | 0.018 | 0.014 | 0.08 | 0.08 | 0.08 | 0.0018 | 0.038 | 0.025 | 0.008 | 0.02 |
| Example 3 | 0.39 | 0.10 | 0.33 | 0.013 | 0.022 | 0.09 | 0.08 | 0.08 | 0.0020 | 0.037 | 0.021 | 0.008 | 0.02 |
| Example 4 | 0.45 | 0.15 | 0.73 | 0.022 | 0.016 | 0.15 | 0.18 | 0.10 | 0.0012 | 0.020 | 0.035 | 0.005 | 0.01 |
| Example 5 | 0.35 | 0.13 | 0.70 | 0.017 | 0.019 | 0.07 | 0.06 | 0.12 | 0.0019 | 0.034 | 0.028 | 0.008 | 0.02 |
| Example 6 | 0.40 | 0.12 | 0.67 | 0.019 | 0.023 | 0.06 | 0.07 | 0.13 | 0.0021 | 0.015 | 0.030 | 0.004 | 0.02 |
| Example 7 | 0.40 | 0.11 | 0.68 | 0.020 | 0.021 | 0.07 | 0.06 | 0.12 | 0.0018 | 0.044 | 0.035 | 0.010 | 0.02 |
| Control 1*[1] | 0.39 | 0.26 | 1.47 | 0.017 | 0.020 | 0.08 | 0.08 | 0.08 | — | — | 0.024 | 0.008 | 0.01 |
| Control 2 | 0.40 | 0.27 | 1.02 | 0.018 | 0.019 | 0.07 | 0.09 | 0.10 | — | — | 0.025 | 0.009 | 0.02 |
| Example 8 | 0.40 | 0.14 | 0.51 | 0.021 | 0.020 | 0.08 | 0.10 | 0.30 | 0.0020 | 0.031 | 0.028 | 0.007 | 0.02 |
| Example 9 | 0.39 | 0.13 | 0.60 | 0.018 | 0.018 | 0.11 | 0.07 | 0.13 | 0.0017 | 0.025 | 0.033 | 0.006 | 0.09 |
| Example 10 | 0.40 | 0.15 | 0.63 | 0.019 | 0.017 | 0.10 | 0.11 | 0.22 | 0.0015 | 0.030 | 0.031 | 0.007 | 0.07 |
| Control 3 | 0.34 | 0.15 | 0.28 | 0.017 | 0.018 | 0.11 | 0.12 | 0.13 | 0.0018 | 0.031 | 0.029 | 0.007 | 0.01 |
| Control 4*[2] | 0.34 | 0.15 | 0.28 | 0.017 | 0.018 | 0.11 | 0.12 | 0.13 | 0.0018 | 0.031 | 0.029 | 0.007 | 0.01 |

*[1]SAE-1541

*[2]Obtained by spheroidized annealing of the steel ingot of Control 3.

After the individual steel ingots shown in Table 1 were heated to 1,050° C., they were cold-milled at the finishing temperature of 850° C. and the area reduction rate of 97%, so that round bars of 28-mm diameter were obtained. The round bars were then cooled naturally in the atmosphere.

For each of these milled round bars, the ferrite grain size number, microstructure, hardness, and decarbonized depth were determined in accordance with the following specifications, without a change of state, and the cuttability and induction hardenability were measured under the following conditions.

Ferrite grain size number: Measured according to JISG0552.

Microstructure: Observed through an optical microscope.

Hardness: Measured according to JISZ2245. Depth of decarbonization: Measured according to JISG0558.

Cutting test: Each steel shaft material was drilled under the following conditions, and the tool life for each shaft material was given as a relative value compared to 100 for the steel material of Example 9, regarding the point of time when the tool became unable to cut as the end of the tool life.

Tool: SKH51 (equivalent to AISIM2); Φ5.

118° feed: 0.1 mm/rev.

Hole depth: 20 mm (blind hole).

Speed: 30 m/min.

Lubricating oil: None.

Induction hardenability: Each steel shaft material was machined into a test piece of 25-mm diameter and 100-mm length, which was hardened at the frequency of 100 kHz, output of 60 kW, and moving speed of 5 mm/sec, and the depth (mm) of the resulting effective case (for Vickers hardness of HV450) was measured. Table 2 collectively shows these results.

TABLE 2

| | Ferrite grain size number | Microstructure | Hardness (HRB) | Decarbonized depth (DM-T, mm) | Tool life (relative value) | Depth of effective case (mm) |
|---|---|---|---|---|---|---|
| Example 1 | 8.0 | Ferrite and lamellar pearlite only | 85 | 0.08 | 94 | 2.2 |
| Example 2 | 8.8 | Ferrite and lamellar pearlite only | 89 | 0.09 | 86 | 2.6 |
| Example 3 | 6.4 | Ferrite and lamellar pearlite only | 82 | 0.10 | 83 | 2.0 |
| Examplr 4 | 8.1 | Ferrite and lamellar pearlite only | 88 | 0.14 | 100 | 2.7 |
| Example 5 | 8.2 | Ferrite and lamellar pearlite only | 83 | 0.07 | 86 | 2.1 |
| Example 6 | 7.8 | Ferrite and lamellar pearlite only | 85 | 0.08 | 96 | 2.3 |
| Example 7 | 8.1 | Ferrite and lamellar pearlite only | 86 | 0.09 | 100 | 2.2 |
| Control 1 | 9.4 | 70% of bainite contained | 98 | 0.10 | 21 | 2.5 |
| Control 2 | 9.0 | 20% of bainite contained | 94 | 0.11 | 46 | 1.9 |
| Example 8 | 8.2 | Ferrite and lamellar pearlite only | 86 | 0.07 | 96 | 2.4 |
| Example 9 | 7.8 | Ferrite and lamellar pearlite only | 87 | 0.06 | 100 | 2.4 |
| Example 10 | 8.1 | Ferrite and lamellar pearlite only | 87 | 0.07 | 98 | 2.4 |
| Control 3 | 5.8 | Ferrite and lamellar pearlite only | 79 | 0.09 | 75 | 1.8 |
| Control 4 | 9.4 | Spheroidal texture | 82 | 0.15 | 42 | 2.2 |

EXAMPLE 11

Various types of steel materials which contain 0.45 wt % of carbon, 0.13 wt % of silicon, 0.74 wt % of manganese, 0.001 wt % of phosphorus, less than 0.01 wt % of sulfur, less than 0.01 wt % of copper, less than 0.1 wt % of nickel, less than 0.01 wt % of chromium, less than 0.01 wt % of molybdenum, 0.03 wt % of titanium, 0.030 wt % of aluminum, 0.006 wt % of nitrogen, and the balance of iron and which have different contents of boron were prepared by melting, and were individually shaped into ingot.

The ingots having different boron contents were heated at 1050° C., subjected to finishing operation at 850° C. and at an area reduction rate of 97%, and cooled naturally in the atmosphere to obtain shaft materials of 25 mm in diameter.

These shaft materials were cut to 100 mm long to obtain test rods. Each of the test pieces were subjected to induction hardening under conditions such as a frequency of 100 kHz, an output power of 60 kW, and a moving speed of 5 mm/sec.

Further, the effective case depth (by which an Hv value of 450 can be obtained, expressed in millimeters) formed in each test piece was measured.

The results are shown in FIG. 1 in terms of the relationship between the boron content and the effective case depth.

What is claimed is:

1. A steel shaft material which is capable of being directly cut and induction hardened, which consists essentially of 0.38 to 0.45 wt % of carbon, 0.15 wt % or less of silicon, 0.3 to 1.0 wt % of manganese, 0.0005 to 0.0030 wt % of boron, 0.01 to 0.05 wt % of titanium, 0.01 to 0.06 wt % of aluminum, 0.010 wt % or less of nitrogen, optionally at least one of chromium in an amount of 0.3 wt % or less and molybdenum in an amount of 0.10 wt % or less, and optionally at least one of 0.005 to 0.30 wt % of sulfur, 0.0002 to 0.005 wt % of calcium, 0.005 to 0.30 wt % of lead and 0.005 to 0.10 wt % of tellurium, and iron and unavoidable impurities for the remainder, said steel material having:

a microstructure formed of ferrite and lamellar pearlite, the amount of bainite being 5% or less, and having the ferrite grain size number of 6 or higher, as determined by JISG0552;

a hardness of HRB 80 to 90, as determined by JISZ2245; and a decarbonized depth of DM-T 0.20 mm or less, as determined by JISG0558.

2. The steel shaft material according to claim 1, wherein said steel material contains 0.39 to 0.41 wt % of carbon, 0.15 wt % or less of silicon, 0.60 to 0.80 wt % of manganese, 0.0010 to 0.002 wt % of boron, 0.020 to 0.035 wt % of titanium, 0.015 to 0.035 wt % of aluminum, 0.006 wt % or less of nitrogen.

3. The steel shaft material according to claim 1, which contains 0.30 wt % or less of chromium and/or 0.10 wt % or less of molybdenum.

4. The steel shaft material according to claim 1 or 2, which contains 0.10 to 0.20 wt % of chromium and/or 0.05 to 0.10 wt % of molybdenum.

5. The steel shaft material according to claim 1, which contains 0.005 to 0.30 wt % of sulfur, 0.0002 to 0.005 wt % of calcium, 0.005 to 0.30 wt % of lead, and/or 0.005 to 0.10 wt % of tellurium.

6. The steel shaft material according to claim 1, wherein said steel material has a hardness of HRB 82 to 88, as determined by JIAZ2245.

7. The steel shaft material according to claim 1, wherein said steel material has a decarbonized depth of DM-T 0.15 mm or less, as determined by JISG0558.

8. A steel shaft material which is capable of being directly cut and induction hardened, which consists essentially of 0.39 to 0.41 wt % of carbon, 0.15 wt % or less of silicon, 0.60 to 0.80 wt % of manganese, 0.0010 to 0.002 wt % of boron, 0.020 to 0.035 wt % of titanium, 0.015 to 0.035 wt % of aluminum, 0.006 wt % or less of nitrogen, and iron and unavoidable impurities for the remainder, said steel material having:

a microstructure formed of ferrite and lamellar pearlite, the amount of bainite having 5% or less, and having the ferrite grain size number of 6 or higher, as determined by JISG0552;

a hardness of HRB 82 to 88, as determined by JISZ2245; and a decarbonized depth of DM-T 0.15 mm or less, as determined by JISG0558.

9. A method for manufacturing a steel shaft material which is capable of being directly cut and induction hardened, comprising:

providing a steel ingot consisting essentially of 0.38 to 0.45 wt % of carbon, 0.15 wt % or less of silicon, 0.3 to 1.0 wt % of manganese, 0.0005 to 0.0030 wt % of boron, 0.01 to 0.05 wt % of titanium, 0.01 to 0.06 wt % of aluminum, 0.010 wt % or less of nitrogen, optionally at least one of chromium in an amount of 0.3 wt % or less and molybdenum in an amount of 0.10 wt % or less, and optionally at least one of 0.005 to 0.30 wt % of sulfur, 0.0002 to 0.005 wt % of calcium, 0.005 to 0.30 wt % of lead and 0.005 to 0.10 wt % of tellurium, and iron and unavoidable impurities for the remainder;

heating said steel ingot to a heating temperature of 1,100° C. or below;

milling said steel ingot at a finishing temperature of 950° C. or below and an area reduction rate of 70% or higher; and cooling said milled steel in the atmosphere.

10. The manufacturing method according to claim 9, wherein said steel ingot further includes 0.30 wt % or less of chromium and/or 0.10 wt % or less of molybdenum.

11. The steel shaft material according to claim 8, wherein the amount of bainite is 0%.

12. The steel shaft material according to claim 11, wherein the HRB hardness is 84 to 86.

13. The steel shaft material according to claim 12, wherein the decarbonized depth of DM-T is 0.10 mm or less.

14. The steel shaft material according to claim 13, wherein the silicon is in an amount of 0.10 wt. % or less.

15. The steel shaft material according to claim 14, which further contains one or both of 0.10 to 0.20 wt. % chromium and 0.005 to 0.10 wt. % molybdenum.

16. The steel shaft material according to claim 15, which further contains 0.005 to 0.30 wt. % sulfur, 0.0002 to 0.005 wt. % calcium, 0.005 to 0.30 wt. % lead and 0.005 to 0.10 wt. % tellurium.

17. The steel shaft material according to claim 2, which contains 0.30 wt. % or less of chromium and/or 0.10 wt. % or less of molybdenum.

18. The steel shaft material according to claim 17, wherein the steel has a composition selected from the group consisting of (a) 0.39 wt % C, 0.12 wt % Si, 0.69 wt. % Mn, 0.015 wt % P, 0.021 wt. % S, 0.08 wt. % Cu, 0.08 wt % Ni, 0.08 wt % Cr, 0.0014 wt % B, 0.035 wt % Ti, 0.023 wt % Al, 0.007 wt. % N and 0.01 wt % Mo;

(b) 0.39 wt % C, 0.14 wt % Si, 0.98 wt. % Mn, 0.018 wt. % P, 0.014 wt % S, 0.08 wt. % Cu, 0.08 wt % Ni, 0.08 wt % Cr, 0.0018 wt % B, 0.038 wt % Ti, 0.025 wt % Al, 0.008 wt. % N and 0.02 wt % Mo;

(c) 0.39 wt % C, 0.10 wt % Si, 0.33 wt. % Mn, 0.013 wt. % P, 0.022 wt % S, 0.09 wt. % Cu, 0.08 wt % Ni, 0.08 wt % Cr, 0.0020 wt % B, 0.037 wt % Ti, 0.021 wt % Al, 0.008 wt. % N and 0.02 wt % Mo;

(d) 0.45 wt % C, 0.15 wt % Si, 0.73 wt. % Mn, 0.022 wt. % P, 0.016 wt % S, 0.15 wt. % Cu, 0.18 wt % Ni, 0.10 wt % Cr, 0.0012 wt % B, 0.020 wt % Ti, 0.035 wt % Al, 0.005 wt. % N and 0.01 wt % Mo;

(e) 0.35 wt % C, 0.13 wt % Si, 0.70 wt. % Mn, 0.017 wt. % P, 0.019 wt % S, 0.07 wt. % Cu, 0.06 wt % Ni, 0.12 wt % Cr, 0.0019 wt % B, 0.034 wt % Ti, 0.028 wt % Al, 0.008 wt. % N and 0.02 wt % Mo;

(f) 0.40 wt % C, 0.12 wt % Si, 0.67 wt. % Mn, 0.019 wt. % P, 0.023 wt % S, 0.06 wt. % Cu, 0.07 wt % Ni, 0.13 wt % Cr, 0.0021 wt % B, 0.015 wt % Ti, 0.030 wt % Al, 0.004 wt. % N and 0.02 wt % Mo;

(g) 0.40 wt % C, 0.11 wt % Si, 0.68 wt. % Mn, 0.020 wt. % P, 0.021 wt % S, 0.07 wt. % Cu, 0.06 wt % Ni, 0.12 wt % Cr, 0.0018 wt % B, 0.044 wt % Ti, 0.035 wt % Al, 0.010 wt. % N and 0.02 wt % Mo;

(h) 0.40 wt % C, 0.14 wt % Si, 0.51 wt. % Mn, 0.021 wt. % P, 0.020 wt % S, 0.08 wt. % Cu, 0.10 wt % Ni, 0.30 wt % Cr, 0.0020 wt % B, 0.031 wt % Ti, 0.028 wt % Al, 0.007 wt. % N and 0.02 wt % Mo;

(i) 0.39 wt % C, 0.13 wt % Si, 0.60 wt. % Mn, 0.018 wt. % P, 0.018 wt % S, 0.11 wt. % Cu, 0.07 wt % Ni, 0.13 wt % Cr, 0.0017 wt % B, 0.025 wt % Ti, 0.033 wt % Al, 0.006 wt. % N and 0.09 wt % Mo; and (j) 0.40 wt % C, 0.15 wt % Si, 0.63 wt. % Mn, 0.019 wt. % P, 0.017 wt % S, 0.10 wt. % Cu, 0.11 wt % Ni, 0.22 wt % Cr, 0.0015 wt % B, 0.030 wt % Ti, 0.031 wt % Al, 0.007 wt. % N and 0.07 wt % Mo.

19. The manufacturing method according to claim 10, wherein the heating is carried out at a temperature of 1050° C. or below, the finishing temperature is 750° to 900° C.; and the area reduction rate is 95% or higher.

* * * * *